United States Patent [19]

Yamamoto

[11] 4,373,888

[45] Feb. 15, 1983

[54] APPARATUS FOR MASS-PRODUCING MEDICAL TABLETS

[75] Inventor: Masaki Yamamoto, Osaka, Japan

[73] Assignee: Takeda Chemical Industries, Ltd., Osaka, Japan

[21] Appl. No.: 165,399

[22] Filed: Jul. 2, 1980

[30] Foreign Application Priority Data

Jul. 13, 1979 [JP] Japan ..... 54-89407

[51] Int. Cl.[3] ..... B26B 17/00

[52] U.S. Cl. ..... 425/149; 425/167

[58] Field of Search ..... 425/149, 167

[56] References Cited

U.S. PATENT DOCUMENTS 4,062,914 12/1977 Hinzpeter ..... 425/149

4,238,431 12/1980 Stüben et al. ..... 425/149

FOREIGN PATENT DOCUMENTS 39-11273 2/1964 Japan .

48-20103 6/1973 Japan .

*Primary Examiner*—James R. Hall

*Attorney, Agent, or Firm*—Wenderoth, Lind & Ponack

[57] ABSTRACT

An apparatus for the mass-production of medical tablets wherein interfacial friction between the tablets and the die and punch is prevented by supplying a powdery lubricant in the die cavity, and dispersing the lubricant under compressed air within a confined space including the die and punch thereby to cover the same with the lubricant dust, and charging the die cavity with a material to be molded.

3 Claims, 5 Drawing Figures

APPARATUS FOR MASS-PRODUCING MEDICAL TABLETS

BACKGROUND OF THE INVENTION

1. Field of the Invention

This invention relates generally to the mass-production of medical tablets. More particularly, the invention relates to an apparatus for mass-producing medical tablets wherein interfacial friction between the tablet and the die and punch is prevented whereby problems and difficulties due to interfacial friction, such as capping, lamination and binding, are avoided to ensure a trouble-free molding operation.

2. Description of the Prior Art

It is known in the art that when a powdery or granular material is molded into tablets under heavy load, interfacial friction occurs between the tablets and the punches, and between the tablets and the walls of die cavities. This friction tends to cause various troubles, such as capping, lamination and adhesion, and interrupt the molding operation. In order to avoid these troubles, the common practice is to admix a lubricant with the medicine, and to mold the admixture into tablets. However, the lubricant content is likely to make the tablets fragile, and retard the dissolution rate and/or the disintegration rate of the tablets in the gastric juices. These are fatal defects for medicine.

In essence, a lubricant has only to exist interfacially between the tablets and the dies, wherein its quantity need not be large. At laboratories a lubricant is actually coated by hand on the surfaces of punches and dies, and this practice is found satisfactory. Nevertheless, there are many difficulties in putting this method into industrial practice. In order to improve the situation many proposals have so far been made, some of which are enumerated below:

Japanese Patent Publication No. 41-11273 (1966) discloses a method of spraying a solution or dispersion of a lubricant, onto the surfaces of punches and dies. This method entails a difficulty in selecting an appropriate solvent, and furthermore, it will be of particular disadvantage when a rotary type of tableting machine is employed, in which the spray application must be intermittent and instantaneous so as to be accurately timed with the movement of the punches. In addition, as the rotating speed of the turntable increases, the intervals of spraying must be accordingly short. However, when the rotating speed exceeds a certain limit, it happens that the lubricant droplets fail to reach the top portions of lower punches.

Japanese Patent Publication No. 48-20103 (1973) discloses a method of blowing an air jet containing a dispersed lubricant onto the punches and dies. However, it is extremely difficult to disperse a small amount of lubricant in air, and in general, since the air is a compressible fluid, it is difficult to secure an instantaneous spray intermittently so as to be in timing with the movement of the punches.

U.S. Pat. No. 3,626,043 discloses a method consisting essentially of two stages; firstly, to compress a lubricant per se in a press die, and secondly, to use the same die in which the lubricant film remains on the surfaces after the mold is removed. In this method a double molding is required, which calls for a tableting machine of a double compression type. But this type of tableting machine is large-sized, and the working efficiency will be lower than that of a single compression type because of the reduction in the rotating speed of the turntable which undergoes an increased centrifugal force in accordance with an increase in its diameter. Another disadvantage is that the thickness of the lubricant film is previously determined by the clearance between the punch and the die, thereby making it impossible to control it as desired.

The present invention is directed toward solving the problems encountered with respect to the prior art described above. The object of the invention to provide an improved apparatus for mass-producing medical tablets in which a lubricant is automatically applied to the surfaces of the punches and dies. The lubricant is not allowed to be contained in the molded tablets, and the desired weight of the molded tablets is maintained irrespective of the application of a lubricant.

Another object of the present invention is to provide an improved tableting apparatus which is relatively simple in construction but which ensures a high tableting ability.

Other objects and advantages will become more apparent from the following description when taken in connection with the accompanying drawings.

SUMMARY OF THE INVENTION

According to one advantageous aspect of the present invention there is provided, an apparatus for mass-producing medical tablets of the type including sets of dies and punches adapted to run along a predetermined line during which each set of dies and punches cooperate to mold tablets, wherein the apparatus includes a lubricant dispensing compartment located at a first point where a molded tablet is released from a die cavity by a lower punch ascending up to the rim thereof, and a jet compartment located at a second point where the lower punch is fully lowered, the jet compartment including a jet nozzle for injecting compressed air toward the lower punch, thereby allowing the lubricant to dispense and fill the jet compartment in the form of dust.

DETAILED DESCRIPTION OF THE INVENTION

Figure 1:
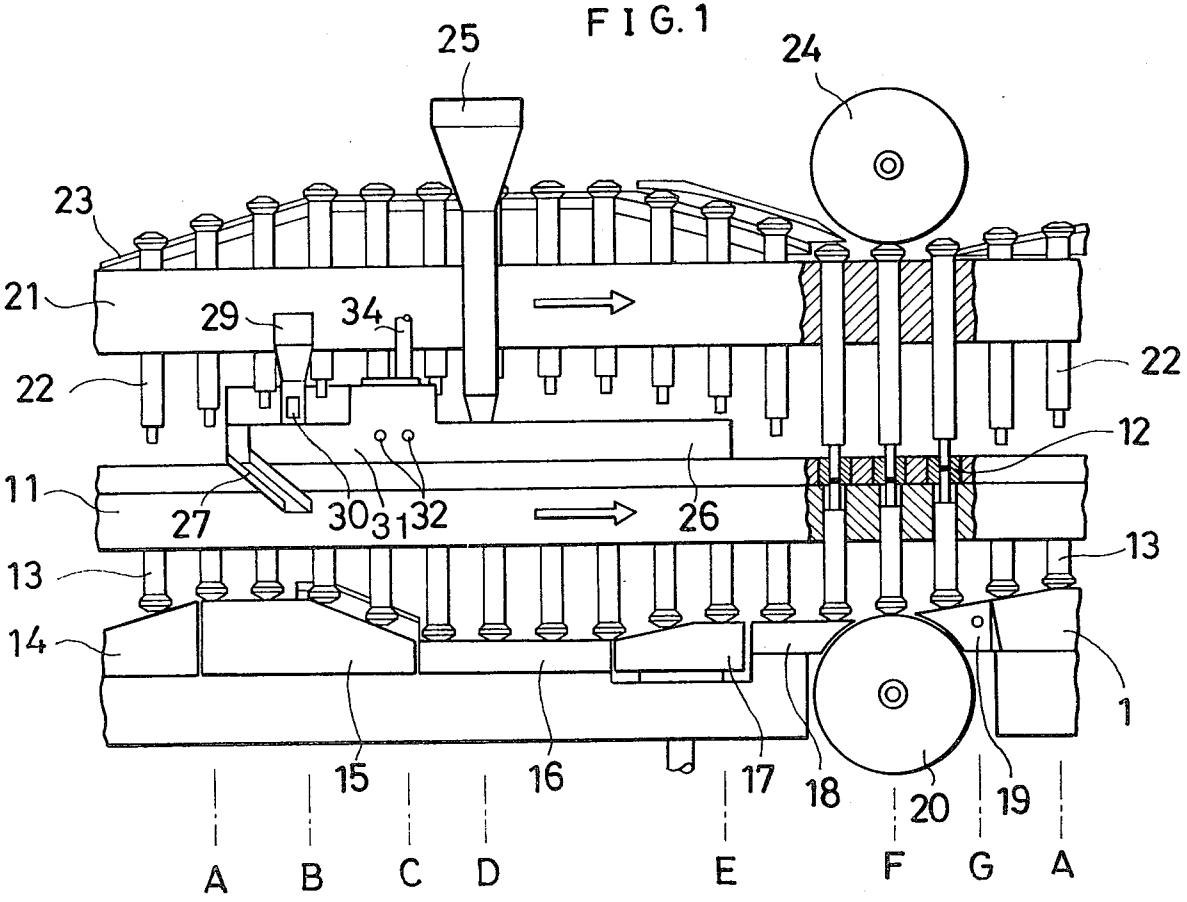
FIG. 1 is a schematic side view, partly broken, showing an apparatus in accordance with the present invention.
Figure 2:
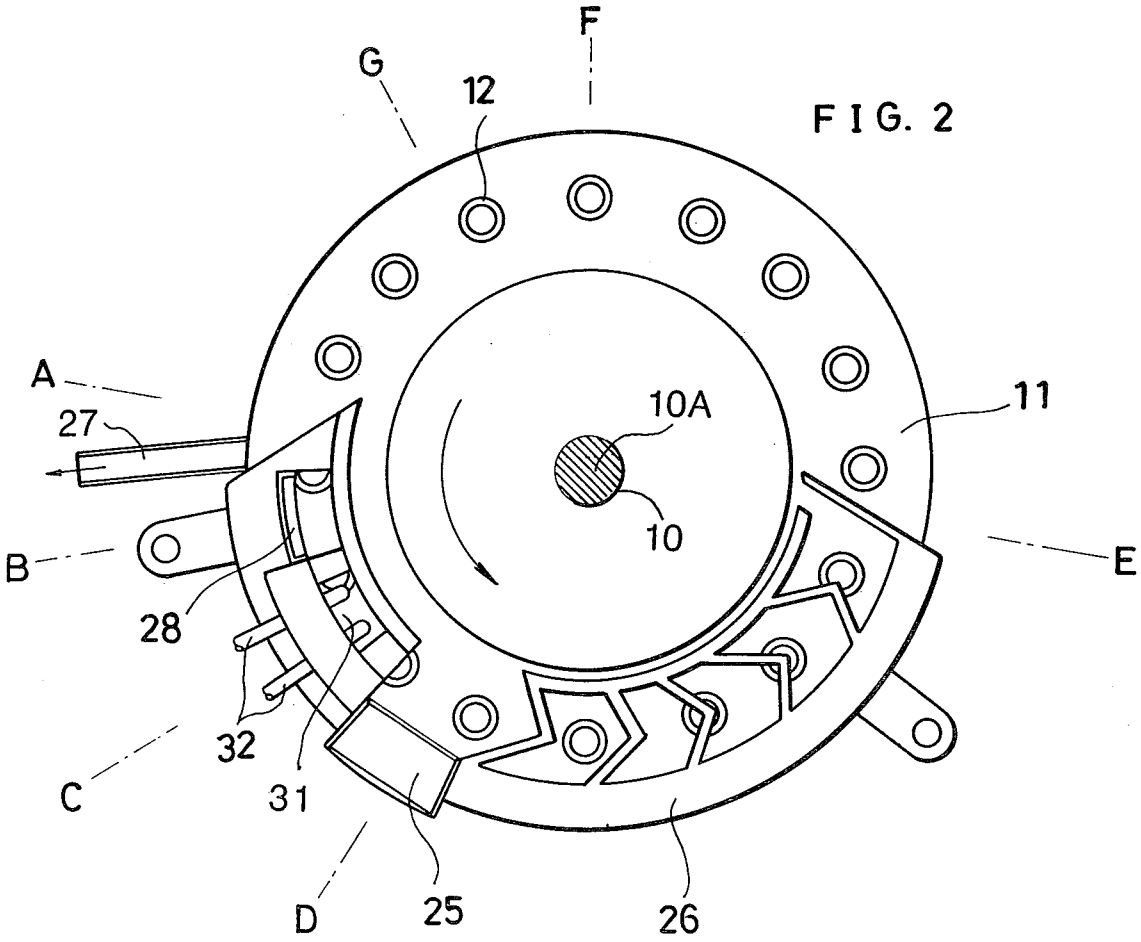
FIG. 2 is a plan view of the apparatus in FIG. 1.

FIG. 1 shows a linear view of the periphery of round turntable 11 (FIG. 2) supported on a rotary central shaft 10 having centerline 10A about which the apparatus rotates horizontally, as indicated by the arrows in the drawing. The turntable 11 is provided with equally spaced die cavities 12 along its periphery. Each die cavity 12 is provided with a lower punch 13 which is vertically movable therein as its bottom end runs on uneven guide rails 14, 15, 16, 17, 18 and 19, and also on a lower compression roller 20, as best shown in FIG. 1. Upper punches 22 are movably supported on a ringshaped holder 21 which rotates in accordance with the rotation of the turntable 11. The upper punch 22 cooperates with the lower punch 13. The upper punches 22 likewise move up and down as they run on an uneven guide rail 23 and an upper compression roller 24. As is evident from the foregoing, the guide rails 14 to 19 and 23 function as cams whereby the upper and lower punches move up and down in the individual die cavities 12 in accordance with the rotation of the turntable 11 and the holder 21.

At station D where the lower punch descends at maximum, there is provided a hopper 25 for supplying powder or granules of a medicinal composition to the die cavities 12. The powder is firstly received in a feeder 26 through which it is filled in each die cavity 12. An excessive amount of powder in the die cavity is scraped off by the edge of the feeder 26 at station E. The filled powder is compressed by the ascending lower punch 13 and the descending upper punch 22 particularly at station F where the punches exert the highest pressure on the molding tablet in the die cavity under the action of the upper and lower compression rollers 20 and 24. As the turntable 11 rotates, the molded tablets are raised to the level of the turntable 11 by the ascending lower punches, and when they reach station A, they are discharged through a chute 27 one after another.

Figure 3:
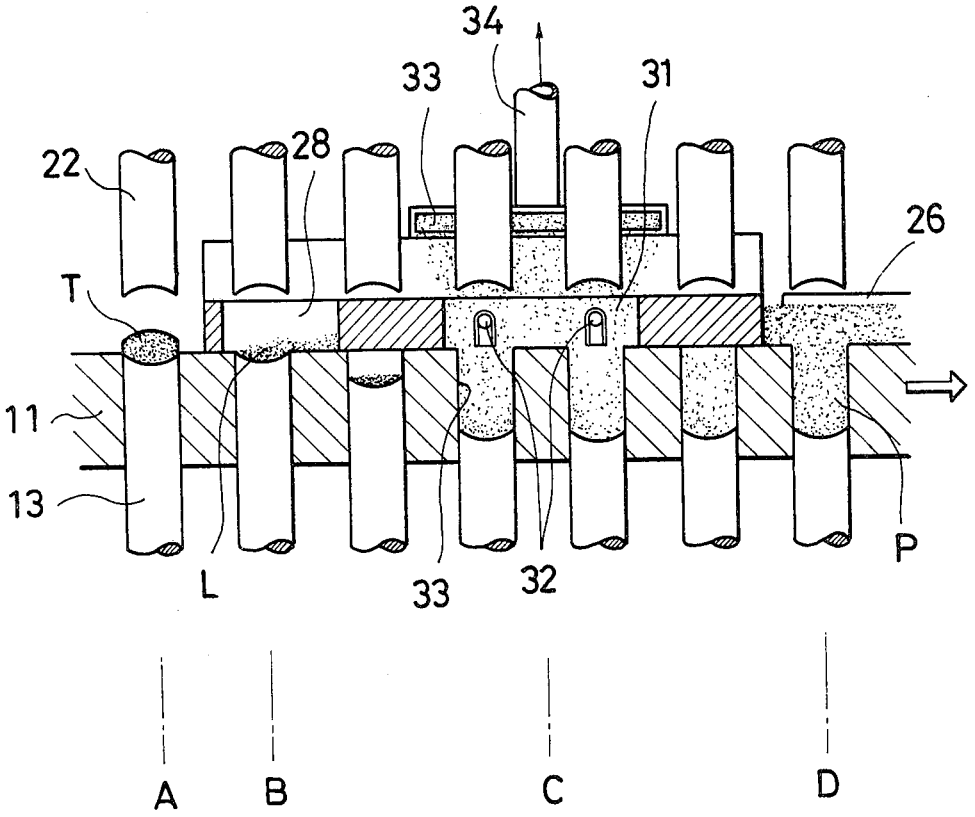
FIG. 3 is a schematic vertical cross-section of the apparatus in FIG. 1, particularly showing the main section thereof.
Figure 4:
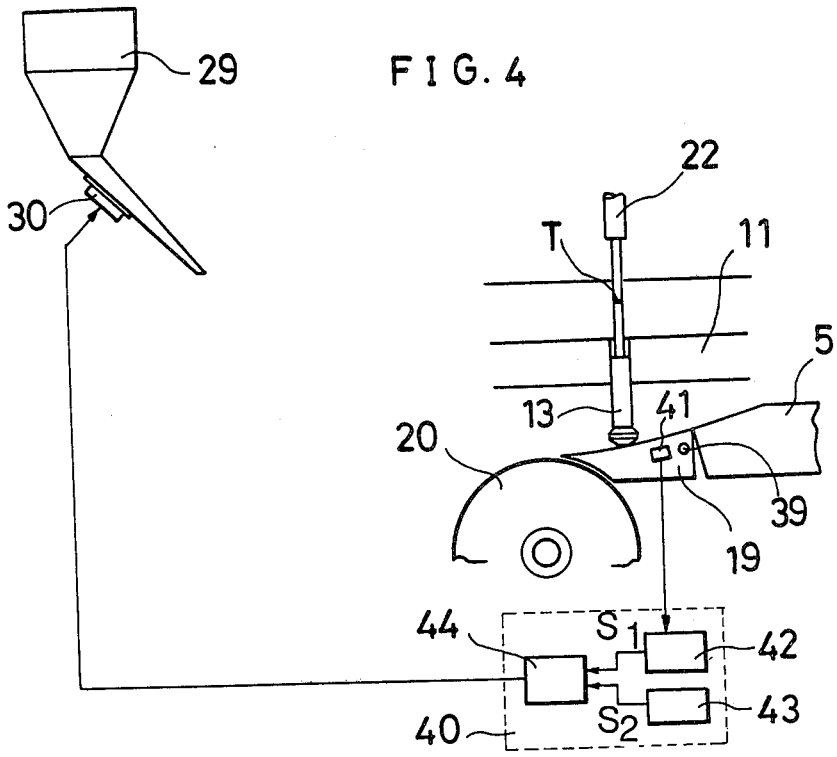
FIG. 4 is a schematic view of a modified version and a circuit diagram.

Referring now to FIGS. 3 and 4, a lubricant dispensing compartment 28 is provided over the turntable 11 at station B, which compartment is adapted to place powdered lubricant L on the top end of the lower punch in accordance with the rotation of the turntable. The compartment is constantly supplied with a predetermined amount of lubricant from a hopper 29 through a feeder 30, which has a controllable valve gate and a vibrator for dispensing the lubricant in a known manner. At station C there is provided a jet compartment 31 over the turntable 11, which jet compartment includes two jet nozzles 32 each directed toward its mating lower punch 13. When a compressed air is injected through the nozzle 32, the lubricant in the die cavity is dispersed and fills the jet compartment 31 in the form of dust. In this way the inside walls of the die cavities and the end faces of both punches 13 and 22 are coated with a layer of lubricant. The remaining swirling particles are collected into a collector 33 through an intake pipe 34. The collector 33 is provided above the jet compartment 31, and the collected lubricant is re-used. The dispensing compartment and the jet compartment and the feeder 26 are preferably constructed in one piece with appropriate partitions.

Referring to FIG. 3, a typical example of operation will be explained:

At station A the molded tablet T is removed from the die cavity. At this stage the lower punch 13 is fully raised as shown in FIG. 3. When the die cavity reaches station B, and passes underneath the dispensing compartment 28, doses from the lubricant heap fall onto the top end of the lower punch. As the turntable rotates, the lower punch is descending with the lubricant on its top end, and reaches station C where the die cavity is underneath the jet compartment 31. The compressed air is constantly injected. When no die cavity comes underneath the jet compartment, the air jet serves to sweep away the lubricant dust remaining on the turntable 11. However, the compressed air can be injected intermittently only when required. The upper and lower punches covered with the lubricant dust advance to station D where as described above, a powdery or granular medicine P is filled in the die cavity to mold a tablet.

The number of jet nozzles depends upon the rotating speed of the turntable. When the turntable 11 rotates at a slow speed, the nozzle can be a single nozzle, but when rotating at a high speed, three or more nozzles will be required, or alternatively, the nozzle can be of a slit type arched along the periphery of the turntable 11.

Referring to FIG. 4 a control system for the supply of lubricant will be explained:

The guide rail 19 is located immediately behind the lower compression roller 20, wherein the root portion thereof is pivotally connected to the body of the machine by means of a pin 39 while the edge portion is supported on the periphery of the compression roller 20 so as to constitute a bridge. The guide rail 19 has a resistance wire strain gauge 41 embedded therein so as to detect any change in load on the lower punch and convert it into electrical signals. The gauge 41 is electrically connected to a detector 42 so as to produce a signal $S_1$, which signal is compared at comparator 44 with a reference signal $S_2$ transmitted from a reference supply 43. If $S_1$ is larger than $S_2$, the valve gate of the feeder 30 is more widely opened, whereas when $S_1$ is smaller than $S_2$, the valve gate thereof is narrowed so as to reduce the supply of lubricant. In this way the amount of lubricant is controlled on the basis of the load induced by the tablet.

Figure 5:
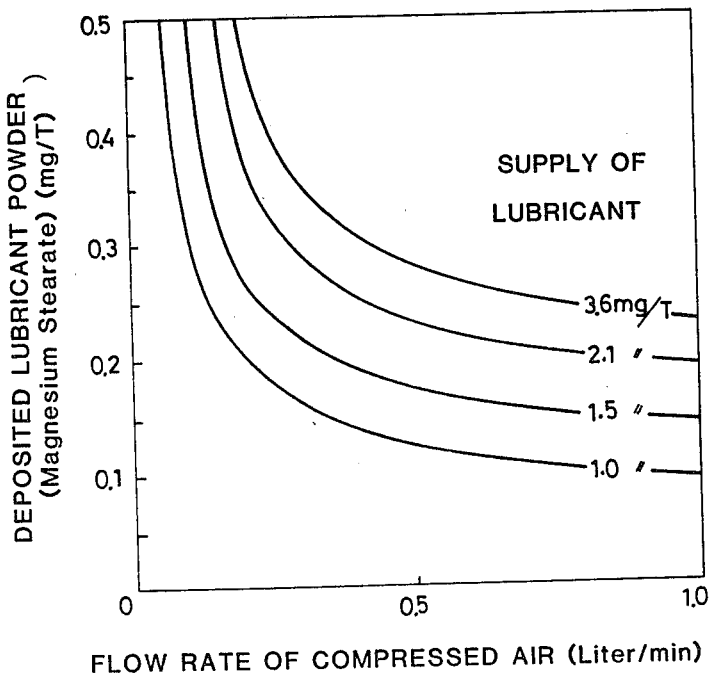
FIG. 5 is a graph showing the relationship between the amount of the deposited lubricant and the flow rate of compressed air.

FIG. 5 shows the relationship between the flowrate of compressed air and the amount of a lubricant (magnesium stearate powder) deposited on the surface of a tablet wherein the supply of lubricant is used as a parameter. The data was obtained in an experiment where the die cavity was 9.5 mm in diameter; the radius of curvature of the punches was 13.5 mm; the nozzle was 2 mm in diameter, and the molding rate was about $10^5$ tablets per hour.

The lubricant used for carrying out the present invention can be selected from a broad range of materials which are in a finely divided form at room temperature, inclusive of the common tableting lubricants such as magnesium stearate, calcium stearate, talc and so forth.

As is evident from the foregoing, an advantage of the present invention is that the deposit of a lubricant can be readily controlled by predetermining the depth of the lower punch. Another advantage of the present invention is that a lubricant can be evenly and thinly adhered to the working surfaces of the punches as well as the inner surfaces of the die cavities under compressed air injected through a jet nozzle within the jet compartment. Furthermore, the present invention can be easily applied to the existing tableting machines without trading off their inherent performance and ability and with the added effect of producing tablets which are adequately hard but which have a proper disintegration rate.

EXAMPLE 1

A powdery mixture of 95% microcrystalline lactose (trade name: EF) and 5% microcrystalline cellulose was molded at a speed of $7.5\times10^4$ tablets per hour. The lubricant used was magnesium stearate, which was supplied at the rate of 2 mg per tablet. The amount of lubricant deposited onto each tablet was 0.15 mg. Each punch was 9.5 mm in diameter and 13.5 mm in radius of curvature. Each tablet weighed 355 mg and was 4.30 mm in thickness. Throughout the experiment no trouble due to interfacial friction was encountered. The hardness of each tablet was 16 Kg.

However, when 2 mg/T (wherein T is tablets) of magnesium stearate was added to the powdery mixture mentioned above, and this mixture was molded into tablets in the conventional manner, no difficulty was encountered in molding tablets, but the hardness of tablet was reduced to 10 Kg.

EXAMPLE 2

97% microcrystalline L-ascorbic acid and 3% alpha-starch were granulated in a fluidized bed, and the granules obtained were molded into 360 mg tablets at a rate of $3\times10^5$ tablets per hour, wherein the punches were 9.5 mm in diameter and 13.5 mm in radius of curvature. The lubricant used was calcium stearate, which was supplied at 3.6 mg/T. The amount of lubricant deposited onto each tablet was 0.4 mg, and the hardness was 14 Kg and the disintegration time was 11 min. The values of disintegration time were measured in water of 37+ C. by the U.S. Pharmacopia National Formulary.

EXAMPLE 3

A powdery mixture of 95% microcrystalline lactose (trade name: EF) and 5% microcrystalline cellulose was molded at a speed of $7.5\times10^4$ tablets per hour. The lubricant used as magnesium stearate, which was supplied at the rate of 0.5%. The amount of lubricant deposited onto each tablet was 0.1%. The punches were 9.5 mm in diameter and 13.5 mm in radius of curvature. Each tablet weighed 355 mg and was 4.46 mm in thickness. Throughout the experiment no trouble due to interfacial friction was encountered. The hardness of each tablet was 7.6 Kg.

However, when 0.3% of magnesium stearate was added to the powdery mixture mentioned above and the mixture was molded into tablets in the conventional manner, the molding was carried out without any trouble but the hardness of the tablet was reduced to 4.2 Kg.

EXAMPLE 4

Aluminum ocetylsalicylate was molded at a pressure of 1.5 ton by means of flat punches of 20 mm diameter, and then the molded product was pulverized into particles of 20 to 100 mesh. This powder was molded at a speed of $7.5\times10^4$ tablets per hour by using punches of 6.5 mm in diameter and 9 mm in radius of curvature, wherein the mass of each tablet was 100 mg and the compression was 2 ton/cm$^2$. Throughout the experiment no trouble due to interfacial friction was encountered. The hardness of each tablet was 5.7 Kg.

For comparison, 0.5% and 1.0% of calcium stearate were respectively added to the powder of aspirin aluminium mentioned above, and each mixture was molded into tablets in the conventional manner. In the case of the mixture containing 0.5% of calcium stearate, sticking and capping occurred 10 seconds after the molding operation was started, and the operation was suspended. In the case of the mixture containing 1.0% of calcium stearate, negligible sticking was noticed but it was not so serious as to suspend the operation. However, the hardness of each tablet was reduced to 3.7 Kg.

What is claimed is:

1. In an apparatus for mass-producing medical tablets, which includes a die cavity support running along a predetermined line, said die cavity support including equally spaced die cavities in the running direction thereof, each of said die cavities being associated with a lower punch ascending and descending therein; an upper punch holder running in parallel with said running direction of said die cavity support, said upper punch holder holding upper punches for ascending and descending in opposite direction to that of said lower punches; medical composition supply means for supplying a medical composition to each said die cavity at a first position where said lower punch in said die cavity is fully lowered to secure a maximum space to receive said medical composition therein; punch compression means for urging said upper and lower punches toward said die cavity to compact the medical composition into tablets; and tablet discharge means for discharging the tablets from said apparatus after said lower punch ascends in said die cavity, said tablet discharge means being located at a second position where said lower punch is fully raised in said die cavity, the improvement comprising:

(a) a lubricant dispensing compartment located adjacent to said second position and being provided with a lubricant supply means, for dispensing powdered lubricant into each said die cavity on top of each said lower punch after said lower punch has reached said second position; and (b) a jet compartment located at said first position, and adapted to confine a dispersed lubricant within said jet compartment, and including a jet nozzle for injecting compressed air toward said lower punch, thereby causing the lubricant on top of said lower punch to disperse and fill said jet compartment.

2. An apparatus as defined in claim 1, further comprising:

(c) detection means for electrically detecting a load exerting upon said lower punch when said lower punch ascends with a molded tablet thereon at said second position, said detection means being provided at said punch compression means where a tablet is ejected after the medical composition is compacted into tablets in said die cavity by said upper and lower punches; and (d) control means for regulating the supply of the lubricant, said control means being electrically connected to said lubricant supply means and being adapted to increase the supply of the lubricant to said die cavity when the load exerted on said lower punch as detected by said detection means is larger than a preset reference value, and to reduce the supply of the lubricant to said die cavity when the load exerting upon said lower punch as detected by said detection means is smaller than said preset reference value.

3. An apparatus as defined in claim 1, wherein the compressed air is constantly injected through said jet nozzle.

* * * * *